US006179374B1

(12) United States Patent
Tang

(10) Patent No.: US 6,179,374 B1
(45) Date of Patent: Jan. 30, 2001

(54) COLLAPSIBLE RECLINING BEACH CHAIR

(76) Inventor: Larry Tang, 45 Park Knoll Dr., East Brunswick, NJ (US) 08816

( * ) Notice: Under 35 U.S.C. 154(b), the term of this patent shall be extended for 0 days.

(21) Appl. No.: 09/551,664

(22) Filed: Apr. 18, 2000

(51) Int. Cl.[7] ..... A47C 4/28
(52) U.S. Cl. ..... 297/45; 297/42
(58) Field of Search ..... 297/45, 42, 16.1, 297/44

(56) References Cited

U.S. PATENT DOCUMENTS 4,595,232 * 6/1986 Glenn et al. .
5,429,413 * 7/1995 Levy et al. .
5,893,605 * 4/1999 Chang .
5,984,406 * 11/1999 Lee .

* cited by examiner

*Primary Examiner*—Milton Nelson, Jr.
(74) *Attorney, Agent, or Firm*—Charles I. Brodsky

(57) ABSTRACT

A reclining beach chair incorporating a frame having pairs of crossed front, rear and side legs, with each leg including a pair of bends in opposing directions in bringing the seat level of the chair closer to the ground, and with connectors for the legs and a tilt-locking mechanism for stabilizing the chair and positively fixing it at the reclining angle set when opened or folded, and for collapsing the chair to a compact package when closed.

12 Claims, 9 Drawing Sheets

COLLAPSIBLE RECLINING BEACH CHAIR

BACKGROUND OF THE INVENTION

1. Field Of The Invention

This invention relates to foldable chairs, in general, and to a collapsible chair especially useful at a beach or seashore location, in particular.

2. Description Of The Related Art

Folding or collapsible chairs in the nature of furniture have been described in such U.S. Pat. Nos. 3,635,520 (Roher et al) and 5,984,406 (Lee). In a multiple seat arrangement, they are also described in U.S. Pat. No. 5,570,928 (Staunton et al). For outdoor use, in camping and watching sports games, chairs of this type have been illustrated in U.S. Pat. No. 5,893,605 (Chang). When a reclining chair is desired for camping, hiking, fishing, and concert events, a construction of the type shown in U.S. Pat. No. 5,882,068 (Levine) is said to be useful.

While chairs of these types may prove adequate to suit their intended purposes, they have proven deficient when employed at beaches or seashore locations where users prefer low seat heights, typically no more than 6" to 10" above ground. While adjustments for multiple reclining positions in these chairs are highly desirable, the need for adjusting the position safely and easily is equally as important. As the reclining chair is oftentimes left unoccupied when open, it is almost as important, if not more so, for the beach chair to have a degree of stability about it, so as to limit its propensity to be blown about by wind gusts, as well as when being sat upon by a user. These various features, however, are not readily available with the type of folding chair arrangements that typify the prior art.

SUMMARY OF THE INVENTION

As will become clear from the following description, the reclining beach chair of the invention replaces the straight leg "X" tubing which characterizes standard designs by an "X" shape tubing incorporating pairs of bends to allow for bringing the seat level of the chair closer to the ground. By replacing the oftentimes used "brake lock" (for free-hand adjustment in sliding the chair back to the desired incline position) with a "positive" slide lock in which a "snap" is secured within a capturing aperture, a true, predetermined locking position results once the recline is set. As will be further described, to increase stability, the beach chair of the invention is constructed to effectively push forward its center of gravity, as by making the rear legs of the chair longer than the front legs. Where desired, a bar can also be fixed between opposing left and right sides of the chair frame back to further stabilize the chair when extended to an open position. In accordance with the invention, both the chair and the stabilizer bar are easily collapsible into a compact package to facilitate the carrying about and storage of this recliner.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
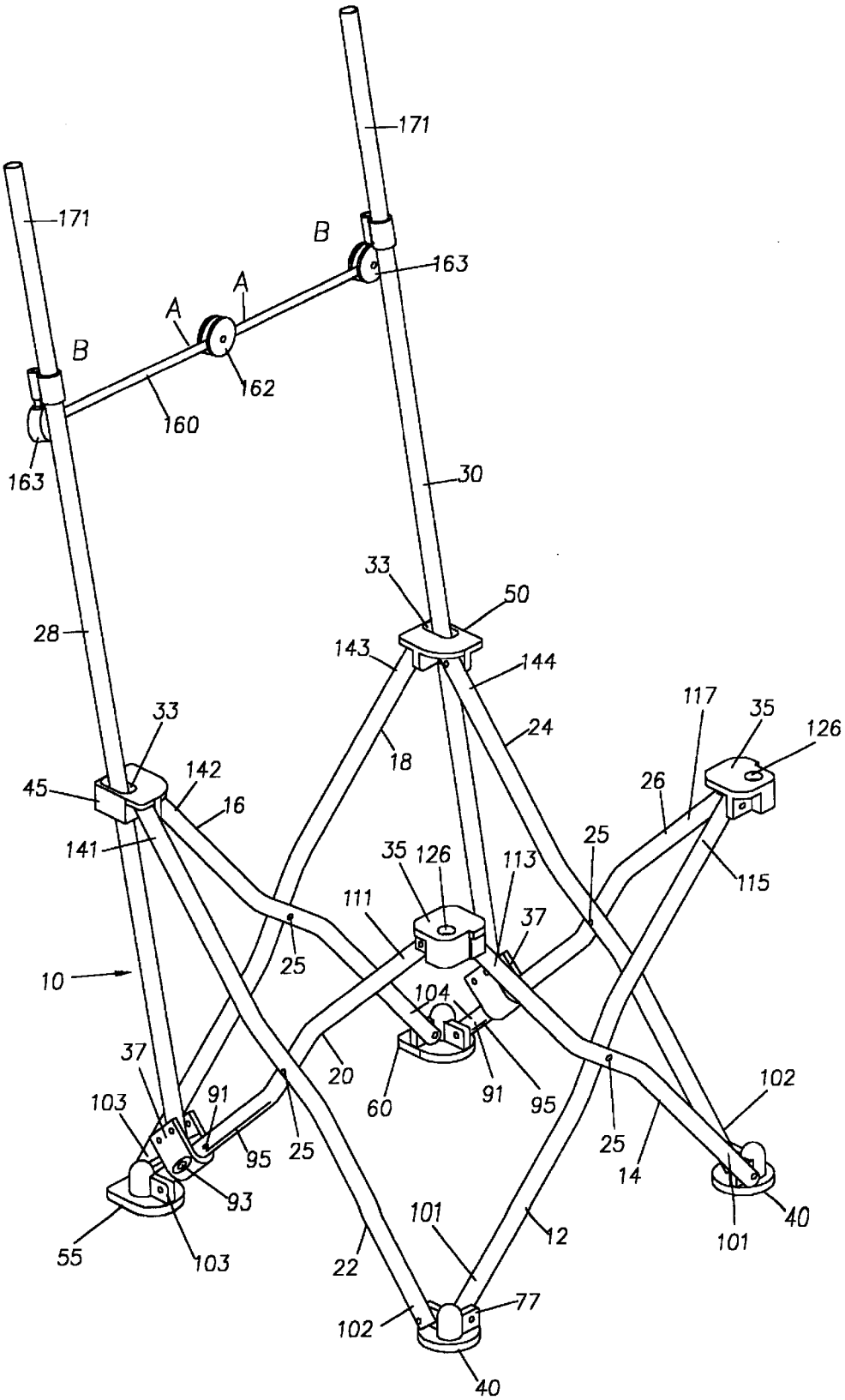
FIG. 1 is a front perspective view of the collapsible reclining beach chair of the invention in an unfolded position, with its seating fabric removed.

As with the folding chair of U.S. Pat. No. 5,984,406, the collapsible reclining beach chair of the present invention is constructed out of tubular members. In particular, the frame of the beach chair 10 includes eight crossed legs in pairs of two each—front legs 12, 14, rear legs 16, 18, and side legs 20, 22 and 24, 26. As illustrated, each of the pairs 12 & 14, 16 & 18, 20 & 22 and 24 & 26 are joined together by pivot pins 25. The frame 10, furthermore, includes a pair of side supports 28, 30—which, like the crossed legs 12 & 14, 16 & 18, 22 and 24 are tubular, and are constructed of aluminum or steel. The side legs 20 and 26, on the other hand, are constructed of extruded aluminum tubing, the reason for which is explained below.

Figure 2:
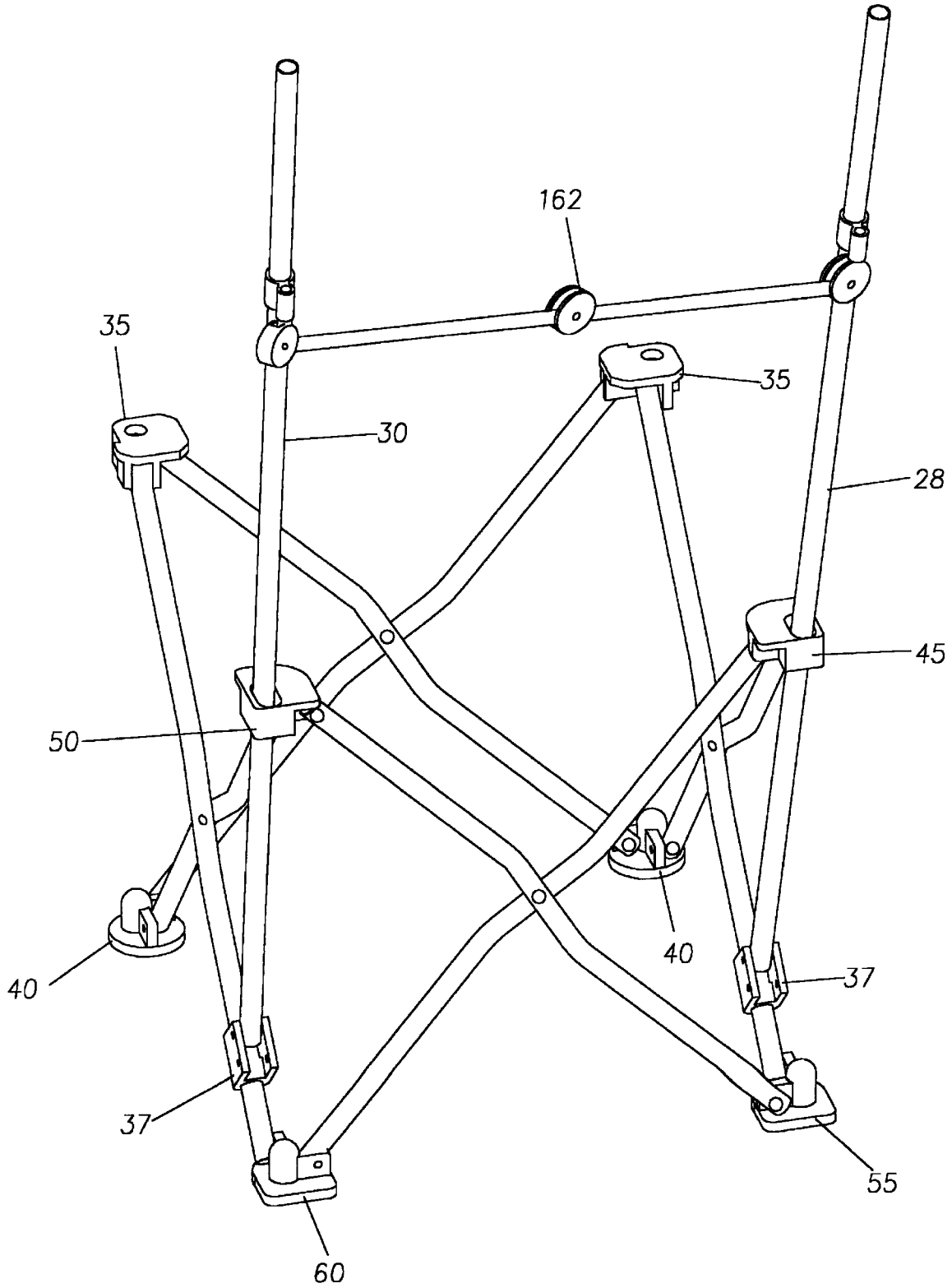
FIG. 2 is a rear perspective view of the reclining beach chair in its unfolded position.
Figure 3:
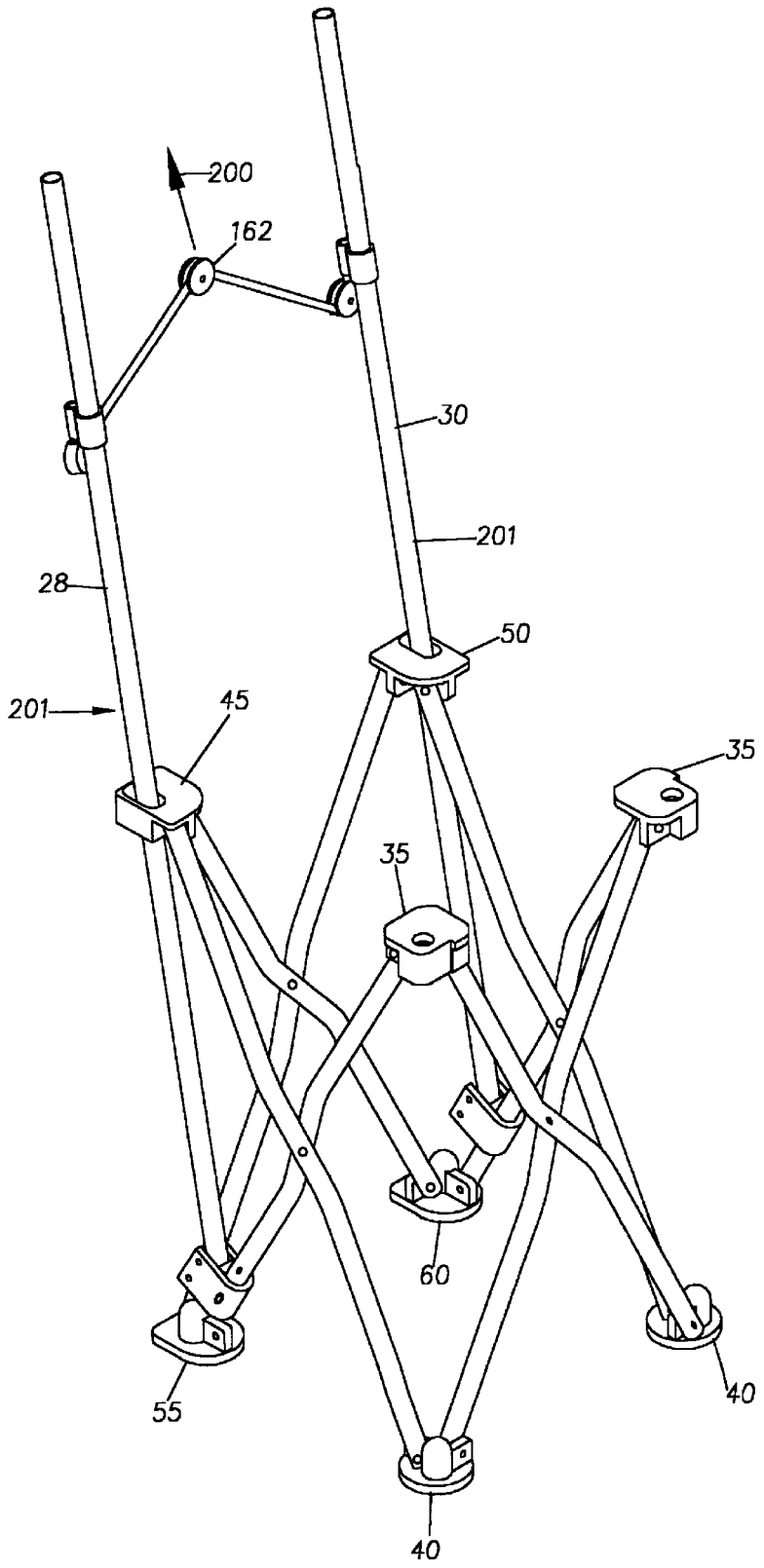
FIG. 3 is a front perspective view of the chair as it is being collapsed.

A pair of front connectors 35 join the crossed legs 14 & 20 and 12 & 26 together at their upper ends. A pair of front pad connectors 40 join the crossed legs 12 & 22 together, as well as the crossed legs 14 & 24, at their bottom ends. Similarly, two rear connectors 45, 50 respectively connect the upper ends of crossed legs 16 & 22 and 18 & 24 at their upper ends. Two rear pad connectors 55, 60 respectively join the lower ends of the crossed legs 18 & 20 and 16 & 26. As shown in FIGS. 1–3, the side supports 28, 30 respectively extend downwardly through apertures 33, in the rear connectors 45, 50, to couple with a sliding lock mechanism 37 arranged to move linearly along the legs 20 and 26. As will be described below, the position of the lock mechanism along the legs 20, 26 sets the angle of recline of the chair frame 10, where it is positively secured in place.

Figure 17:
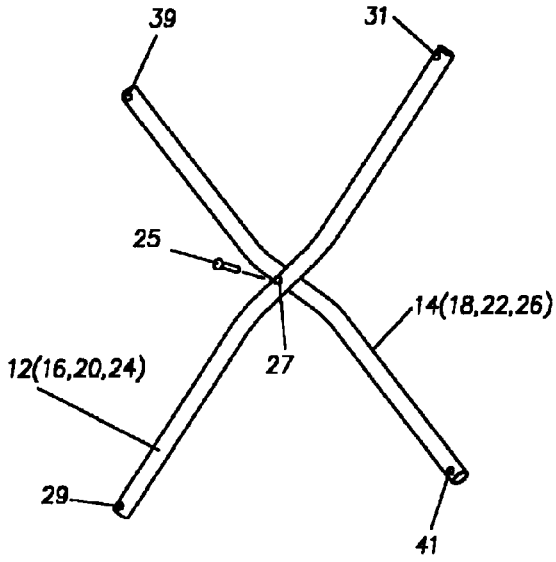
FIG. 17 pictorially illustrates a manner for securing the "X" shaped tubing legs together.
Figure 16A:
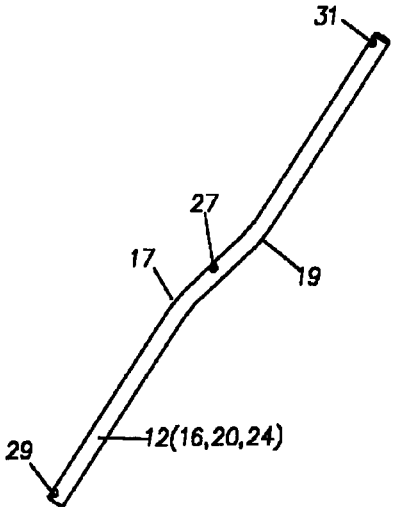
FIG. 16A and 16B pictorially illustrate two of the eight "X" shaped tubing legs of the reclining beach chair with the bends which allow for bringing its seat near to the ground, while allowing the chair to be eventually collapsed compactly.
Figure 16B:
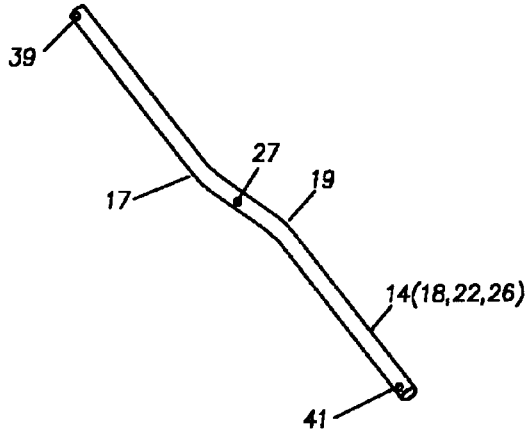

As illustrated in FIGS. 16A & 16B, the cross leg members 12 (also 16, 20, 24) and 14 (also 18, 22, 26) are fabricated with a pair of opposing "bends" at 17, 19 rather than being of "straight" length as are the legs of U.S. Pat. No. 5,984,406. An aperture 27 is provided mid-way between the bends 17, 19 to receive the pivot pin 25 (FIG. 17). Additional apertures 29, 31, 39 and 41 receive rivets or similar such fasteners in coupling the crossed legs 12 & 14, 16 & 18, 20 & 22 and 24 & 26 to the various connectors 35, 40, 45, 55 and 60 of FIG. 1.

Figure 7A:
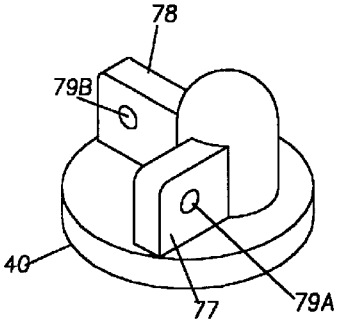

In particular, the lower end 101 of the crossed legs 12 & 14 are fastened by rivet or other appropriate manner to the front wall 77 of the front pad connector 40 shown as having a perpendicular side wall 78 (FIG. 7A), the fastener passing through its aperture 79A. Similarly, the lower end 102 of the crossed legs 22 & 24 also are riveted, or otherwise fastened, tc the perpendicular wall 78, by means of its aperture 79B. As illustrated, both front pad connectors 40 are identical, with one of the lower ends 101 being on one side of the front wall 77, the other lower end being on the opposite side, and with the two lower ends 102 being on opposing faces of the side wall 78.

Figure 9A:
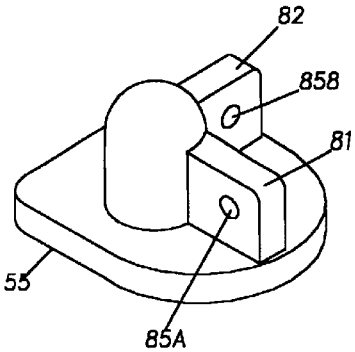
Figure 9B:
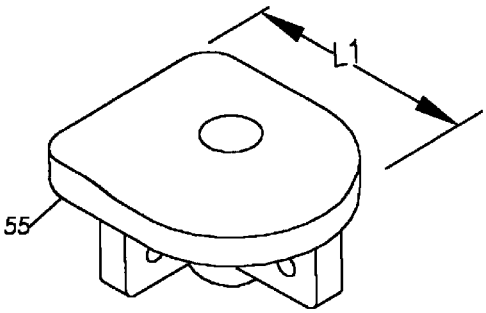
Figure 10A:
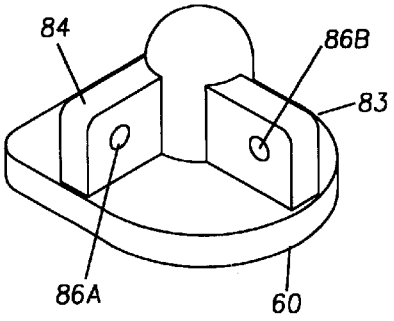
Figure 10B:
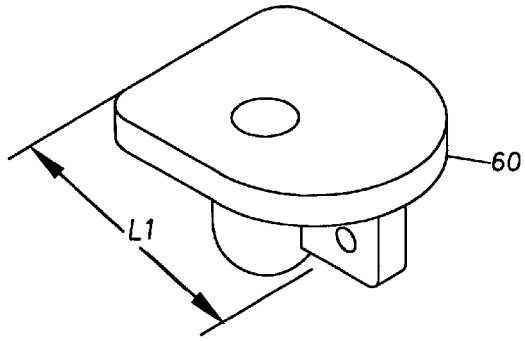
Figure 11A:
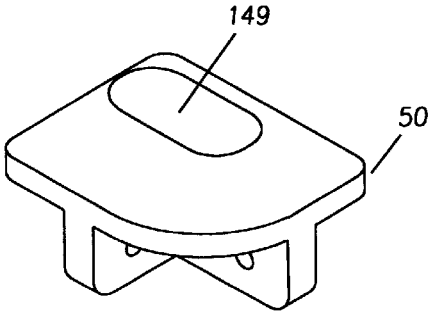
Figure 11B:
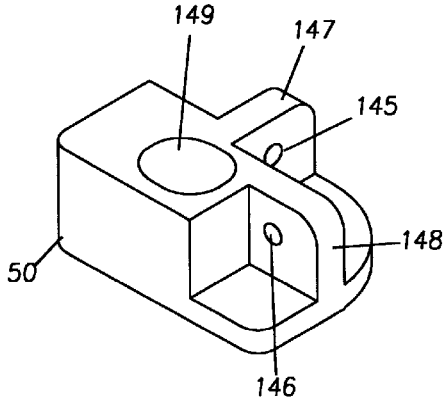
Figure 12A:
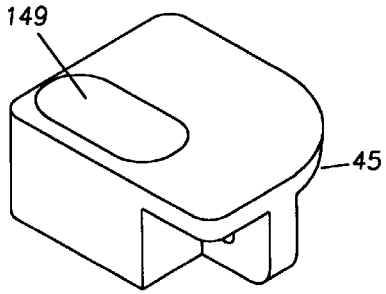
Figure 12B:
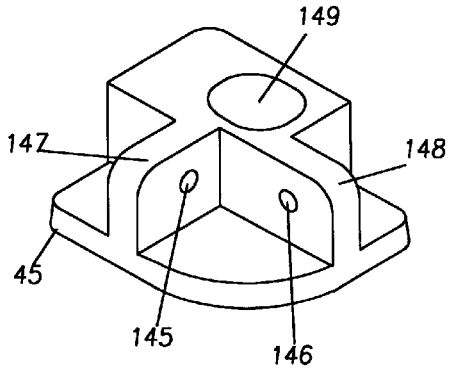

In like manner, the lower end 103 of the crossed legs 18 & 20 and the lower end 104 of the crossed legs 16 & 26 are fastened by rivets, or otherwise, to the rear pad connectors 55, 60 respectively, with the rear pad connector 55 being shown in FIGS. 9A & 9B, and with the rear pad connector 60 being shown in FIGS. 10A & 10B. Each of the connectors 55, 60 similarly include a pair of perpendicular walls 81, 82 and 83, 84, each with their own apertures 85A & 85B and 86A & 86B. As indicated, the lower end 103 of leg 20 is fastened to one side of the wall 81 via aperture 85A while the lower end 103 of leg 18 is fastened to one side of the wall 82 via aperture 85B. Correspondingly, the lower end 104 of leg 26 is fastened to the opposing surface of wall 83 of connector 60 via aperture 86B, while the lower end 104 of leg 16 is fastened to the opposing surface of wall 84 via aperture 86A.

Figure 7B:
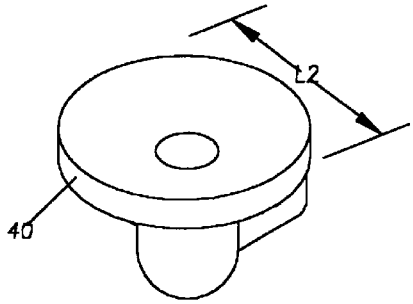
Figure 8A:
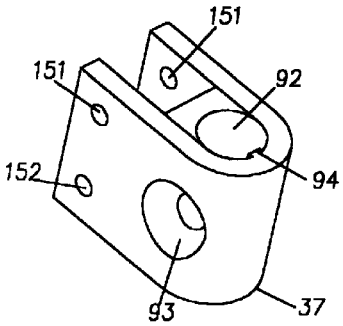
Figure 8B:
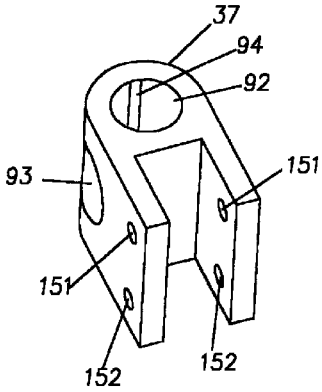

In accordance with the invention, the dimension $L_1$ (FIGS. 9B & 10B) between the front and rear surfaces of the connectors 55 and 60 is greater than the dimension $L_2$ (FIG. 7B) between the front and rear surfaces of the connector 40 (a diameter in the embodiment of FIGS. 7A & 7B) so as to effectively move the center of gravity of the frame 10 forward. This provides a greater stability to the reclining beach chair, a safety feature. Also to enhance stability and safety, a plurality of spaced, compressible pins 91 are included along the lower portion of legs 20 and 26 for fitting within the sliding lock mechanism 37 (FIGS. 8A and 8B). An aperture 92 in mechanism 37 receives the lower portion of the leg, with a second aperture 93 available to accept and capture the pin 91 by snap action to form a positive locking securement. A tab 94, of any desired cross-section, runs along the length of aperture 92 from front to back so as to slide within a linear groove 95 cut along the lower portion of legs 20 and 26 to secure and lock legs 20, 26 against sideways rotation—with the legs fabricated of extruded aluminum, which can be formed with the linear groove 95 as part of the extrusion. As will be appreciated, it is not generally an easy matter to make steel tubing with the groove 95 as required.

The upper end 111 of leg 20 and the upper end 113 of leg 14 are fastened together in front connector 35 in manner identical to the fastening in connector 32 of upper end 115 of leg 12 and upper end 117 of leg 26. The connectors 35 are illustrated in FIGS. 6A & 6B with one of the legs (20 or 12) being fastened through the apertures 121A and 121B of two parallel walls 122, 123, and with the other of the legs (14 or 26) being fastened through the aperture 124 of the perpendicular wall 125. The aperture 126 will be understood as receiving a screw or like fastener extending upwardly through the connector 35 to join with a cap 130 which holds the fabric liner 131 of the chair in place along the front of the seat (FIG. 5).

The upper end 141 of the leg 22 is similarly coupled with the upper end 142 of leg 16 within the connector 45, designed as a mirror image of the connector 50 which receives the upper end 143 of leg 18 and the upper end 144 of leg 24. These connectors 45 and 50 are illustrated in FIGS. 12A & 12B and 11A & 11B, respectively, with one leg fastened through each aperture 145, 146 of the perpendicular walls 147, 148, and with the aperture 149 corresponding to the aperture 33 in the connectors 45 and 50 of FIG. 1.

As illustrated in FIG. 1, to complete the basic frame 10 of the reclining beach chair, the side supports 28 and 30 pass through the aperture 33 in the connectors 45 and 50 to fasten by rivets or otherwise to the slide locking mechanism 37, and more particularly between the apertures 151—151 or 152—152—as illustrated in FIGS. 8A & 8B.

Figure 5:
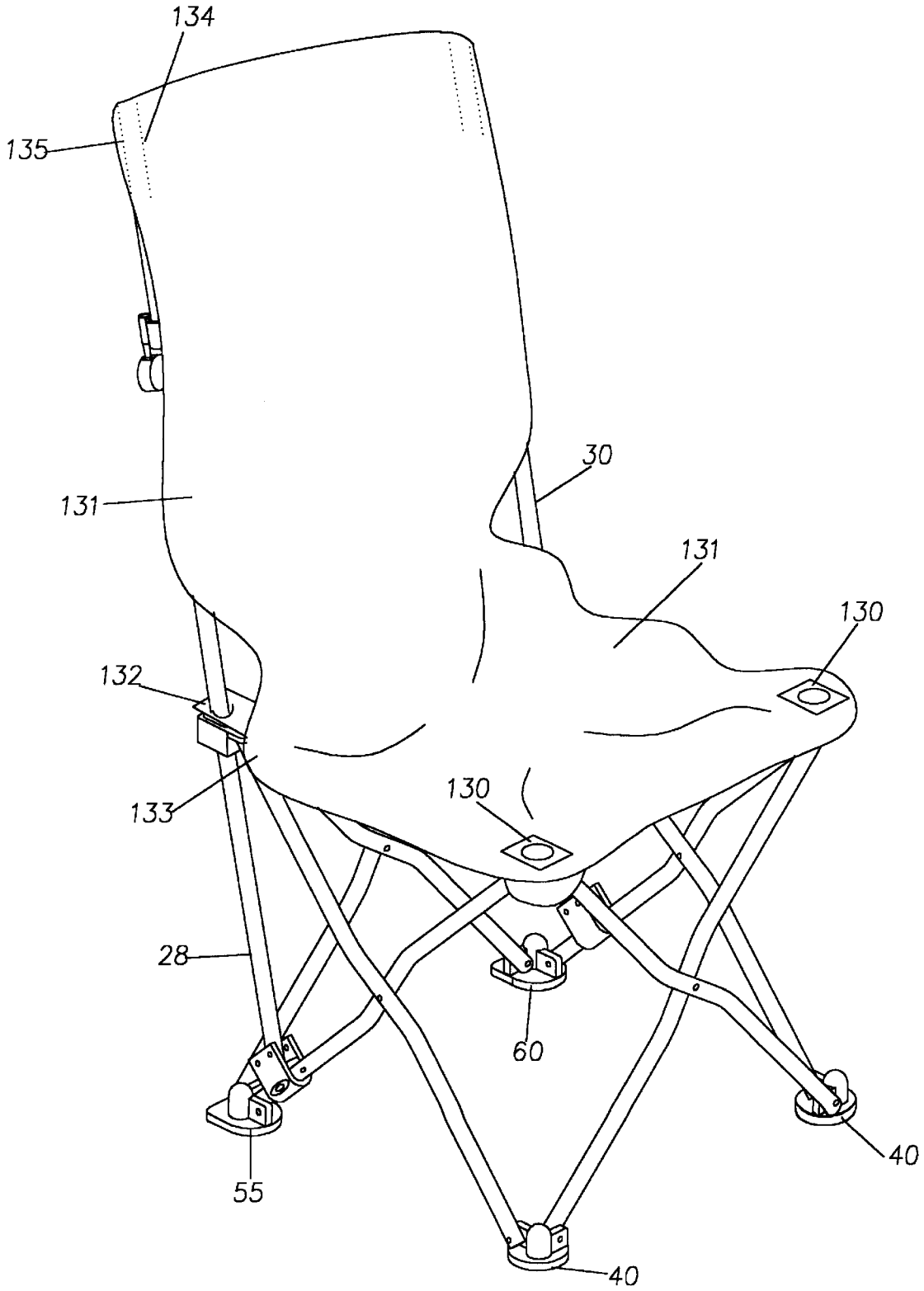
FIG. 5 is a front perspective view of the collapsible reclining beach chair in its unfolded position, with the seating fabric in place.
Figure 6A:
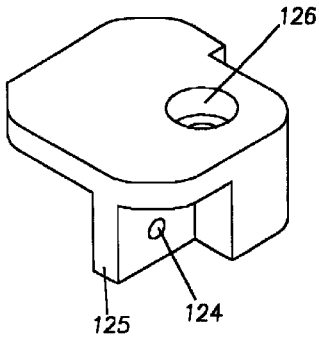
FIGS. 6A & 6B, 7A & 7B, 8A & 8B, 9A & 9B, 10A & 10B, 11A & 11B, 12A & 12B, and 13A & 13B are top and bottom perspective views respectively of various component parts of the beach chair of the invention, which allow the chair to be opened, low to the ground when in use, and to be collapsed for storing away (in a duffle-type bag, for example) once the chair is fully collapsed.
Figure 6B:
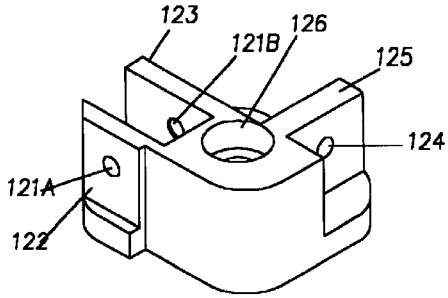

FIG. 5 illustrates the manner of attaching the fabric liner 131 to the chair frame 10. As previously mentioned, a cap 130 secures the front of the liner to the front of the frame. A strap 132 is sewn at left and right undersides 133 of the fabric liner 131, and is provided with an opening defined by a grommet (not shown), through which the side supports 28, 30 pass. A sleeve 134 is included at the rear underside of the fabric liner 131, to slip over the top 135 of the side supports 28, 30, reinforced in any desired manner. As shown, the strap 132 rests atop the rear connectors 45, 50.

With the frame 10 incorporating a pair of bends 17, 19 spaced about the pivot point 27, the seat level of the chair can be brought lower to the ground, to as low as six inches above it, as many users at a beach or seashore location prefer. By providing a slide locking mechanism 37 along the legs 20 and 26, the beach chair can be reclined to the desired angle, and with the snap provided through the multiple push pin positions with its capturing aperture 93, a secure lock at the desired position results. By making the rear pad connectors 55, 60 longer than the front pad connectors 40, further increased stability follows. With the position locking arrangements typifying the prior art, freeways rotational turning of the frame was experienced because of the "roundness" of the tubing employed in the lock—a possibility which is virtually eliminated through the scoring of the cross legs 20 and 26 at the groove 95, in receiving the tab 94 of the snap lock 37. In a preferred embodiment of the invention, the bends 17, 19 extend on either side of the pivot pins 25 a distance of 2 to 4 inches, depending upon how low to the ground the seat level of the frame 10 is to go. At the same time, the position to which the recline is set is adjustable either before or after the chair is opened.

Figure 13A:
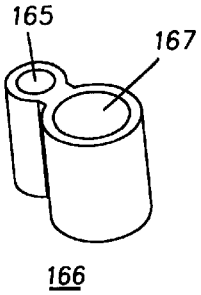
Figure 13B:
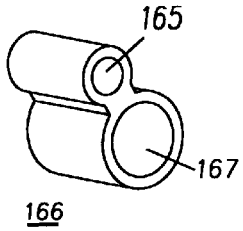
Figure 14A:
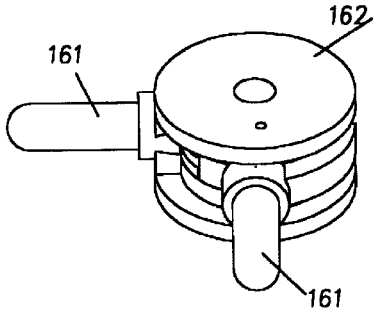
FIGS. 14A & 14B and 15A & 15B are top perspective views of components helpful in an understanding of the operation of the optional stabilizer bar of the invention.
Figure 14B:
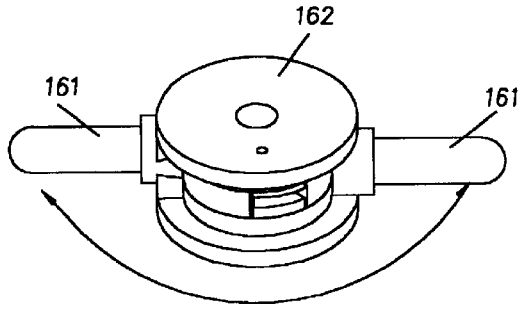
Figure 15A:
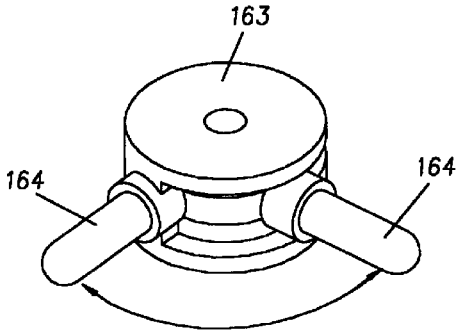
Figure 15B:
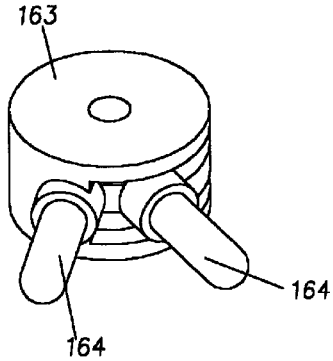

While the reclining beach chair as so far described performs quite well, a further feature of the design offers even greater stability in windy conditions, through the use of a bar 160 hinged between the supports 28, 30. Shown in FIG. 1, such bar 160 may be of a 2-piece tubular construction, fitted at one end "A" onto a rotatable extension 161 of a roller hinge 162 (FIGS. 14A & 14B showing the limits of rotation). At the opposite end "B" of the bar construction, a hinged bracket 163 is provided with its own rotatable extension 164 to fit within the tubular length (FIGS. 15A & 15B illustrating the rotational limits of this hinge). As shown in FIGS. 1, 13A and 13B, one rotatable extension 164 on each hinge 163 fits within an opening 165 in a coupler 166, a second opening 167 of which goes over the upper end 171 of the side supports 28, 30, where it is held by a press fit. When fabricating the bar 160 of aluminum or other stiffening material, not only is back support provided for the fabric of the chair, but stability of the side supports 28, 30 is present against ensuing wind.

Figure 4:
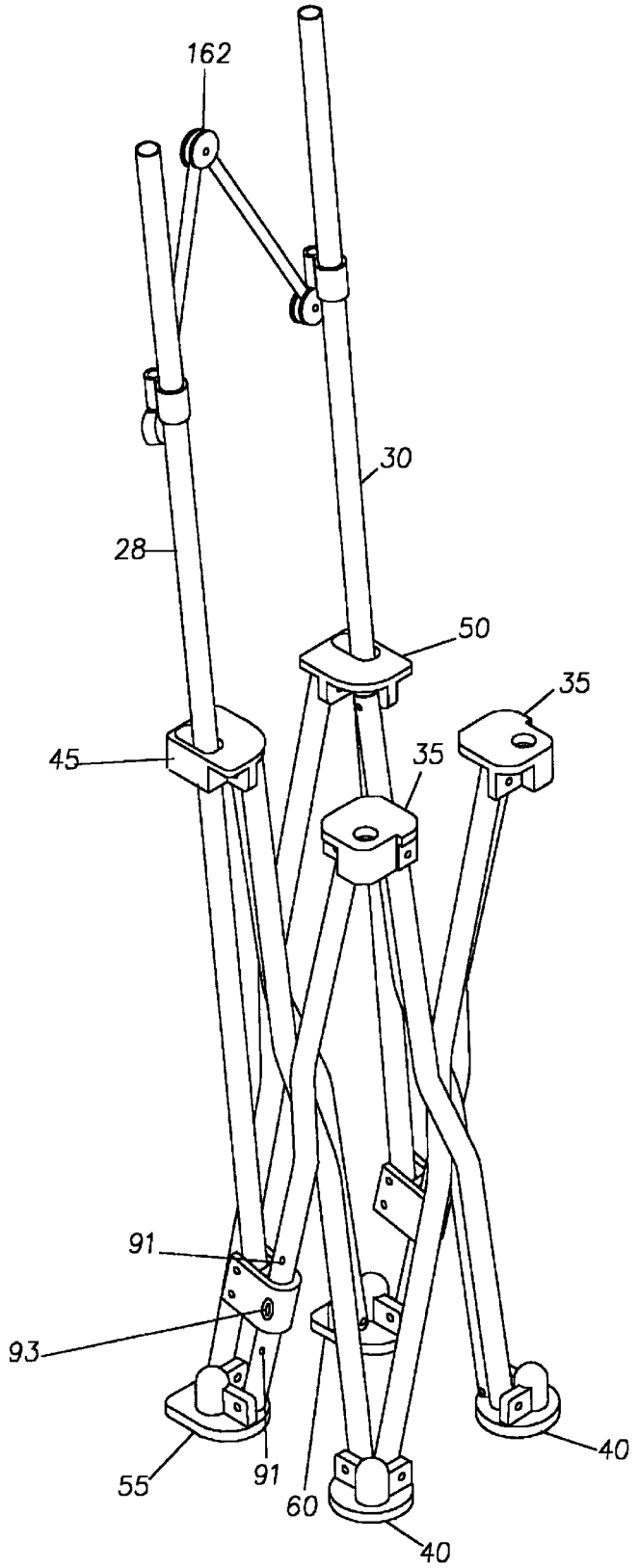
FIG. 4 is a front perspective view of the beach chair when fully collapsed, ready for storage.

FIG. 3 illustrates the first step in collapsing the reclining beach chair after use, where the stabilizer bar 160 is employed. Namely, the roller hinge 162 is lifted upwardly, as shown by the arrow 200, which exerts a pressure on the side supports 28, 30, in the direction of the arrows 201 pulling the supports toward each other. The motion rotates the locking mechanisms and the various legs and connectors inwardly, to take on the compact configuration of FIG. 4. Such action raises the rear connectors 45 and 50, to lift the fabric liner 131 which rests thereon, to collapse it as well, wherein the beach chair, then in a collapsed condition, can be placed in a duffle bag and carried about, or otherwise stored. Where the stabilizer bar 160 is not employed, only a gentle pressure on the supports 28, 30 in the direction of the arrows 201 is all that is necessary to begin the collapsing action.

While there have been described what are considered to be preferred embodiments of the present invention, it will be readily appreciated by those skilled in the art that modifications can be made without departing from the scope of the teachings herein. For example, whereas compressible pins 91 are set out to snap the slide lock mechanism 37 in secured position, other manners of fastening the mechanism in place can be utilized instead—such as by a lever and actuating spring to force a pin as part of the mechanism itself into the extruded tubing. For at least such reason, therefore, resort should be had to the claims appended hereto for a true understanding of the scope of the invention.

What is claimed is:

1. A collapsible chair comprising:

a frame including pairs of front crossed legs and rear crossed legs, and two pairs of side crossed legs, with each pair of crossed legs being pivotally connected together where they cross;

first and second front pad connectors pivotally connected to lower ends of one of said front crossed legs and one of said side crossed legs, respectively;

first and second rear pad connectors pivotally connected to lower ends of one of said rear crossed legs and the other of said side crossed legs, respectively;

first and second front connectors pivotally connected to upper ends of said one front crossed leg and said other of said side crossed legs, respectively;

first and second rear connectors pivotally connected to upper ends of said rear crossed legs and said one of said side crossed legs, respectively;

a pair of side supports passing through apertures in each of said first and second rear connectors having lower ends pivotally connected along a lower portion of said other of said side crossed legs, respectively; and a fabric liner connected to said first and second front connectors and to upper ends of said pair of side supports;

with each of said front, rear and side crossed legs being bent outwardly in opposing direction on either side of its respective points of pivot connection.

2. The collapsible chair of claim 1, also including a strap on an underside of said fabric liner resting atop said first and second rear connectors.

3. The collapsible chair of claim 1 wherein each of said bends extend on either side of its respective pivot connection point a distance of 2 to 4 inches.

4. The collapsible chair of claim 1 wherein a front-to-rear dimension of said rear pad connectors is greater than a front-to-rear dimension of said front pad connectors.

5. The collapsible chair of claim 4 wherein each of said front and rear pad connectors include a pair of perpendicular apertured walls;

with one wall of said first and second front pad connectors being pivotally connected on opposite sides with said lower ends of said front crossed legs;

with the other wall of said first and second front pad connectors being pivotally connected on opposite sides with said lower ends of said one side crossed legs;

with one wall of said first and second rear pad connectors being pivotally connected on opposite sides with said lower ends of said rear crossed legs; and with the other wall of said first and second rear pad connectors being pivotally connected on opposite sides with said lower ends of said other side crossed legs.

6. The collapsible chair of claim 1, also including a hinged bar extending between said pair of side supports along an upper portion thereof.

7. The collapsible chair of claim 6, additionally including a pair of hinged brackets for coupling opposite ends of said hinged bar to individual ones of said side supports.

8. The collapsible chair of claim 1, also including first and second lock mechanisms pivotally connected to said lower ends of said side supports, and having a first aperture for sliding along said lower portion of said other of said side crossed legs.

9. The collapsible chair of claim 8 additionally including a plurality of spaced compressible pins along said lower portion of said other of said side crossed legs, and wherein said lock mechanism includes a second aperture for receiving individual ones of said pins in securement therewith.

10. The collapsible chair of claim 8 wherein said other of said side crossed legs include a linear groove along said lower portion, and wherein said first aperture of said lock mechanism includes a tab secured within said groove.

11. The collapsible chair of claim 10 wherein said tab is of a cross-section to slide within said linear groove.

12. The collapsible chair of claim 10 wherein said other of said side crossed legs is constructed of extruded aluminum tubing, while said one of said side crossed legs and said front and said rear crossed legs are constructed of aluminum or steel tubing.

* * * * *